United States Patent [19]

Ferraro

[11] Patent Number: 4,511,608

[45] Date of Patent: Apr. 16, 1985

[54] ARTIFICIAL NAIL MOUNTING, REINFORCEMENT, AND METHOD

[76] Inventor: Charlotte L. Ferraro, 236 Paterson Ave., Lodi, N.J. 07644

[21] Appl. No.: 432,324

[22] Filed: Dec. 7, 1982

[51] Int. Cl.[3] ..... A45D 31/00

[52] U.S. Cl. ..... 428/15; 132/73; 156/61; 428/40

[58] Field of Search ..... 132/73; 428/40, 41, 428/42, 43, 906; 156/61, 63, 289

[56] References Cited

U.S. PATENT DOCUMENTS

| | | | |
|---|---|---|---|
| 2,234,657 | 3/1941 | Smaldone | 132/73 UX |
| 2,633,139 | 3/1953 | Pettey | 132/73 |
| 2,688,331 | 9/1954 | Bogoslowsky | 132/73 |
| 3,508,754 | 4/1970 | Shorin | 428/42 X |
| 3,598,685 | 8/1971 | Lee et al. | 132/73 X |
| 3,645,835 | 2/1972 | Hodgson | 132/73 X |
| 3,962,833 | 6/1976 | Johnson | 51/323 X |
| 3,972,325 | 8/1976 | Bluestone | 132/73 X |
| 3,987,901 | 10/1976 | Dullinger | 206/451 |

FOREIGN PATENT DOCUMENTS

| | | | |
|---|---|---|---|
| 933981 | 8/1963 | United Kingdom | 132/73 |
| 1252075 | 11/1971 | United Kingdom | 132/73 |
| 1280700 | 7/1972 | United Kingdom | 132/73 |

*Primary Examiner*—Henry F. Epstein
*Attorney, Agent, or Firm*—Kenneth Watov

[57] ABSTRACT

A double-sided, pressure sensitive adhesive tape is dimensioned to form a tab for covering a substantial portion of a human nail, permitting one side of the tab to be secured to the human nail, and the other side of the tab to be secured to an artificial nail, thereby providing a means for both mounting an artificial nail to a human nail, and for reinforcing the artificial nail.

13 Claims, 8 Drawing Figures

ARTIFICIAL NAIL MOUNTING, REINFORCEMENT, AND METHOD

FIELD OF THE INVENTION

The field of the present invention relates to artificial nails, and more specifically to a method and apparatus for mounting and reinforcing artificial nails.

BACKGROUND OF THE INVENTION

Many different artificial nail products are available in the marketplace. All such known artificial nails present problems to a prospective user, making the nails inconvenient and impractical for use in many situations. Certain artificial nail products require a user to glue each artificial nail to the natural or human nail, and to use a solvent to remove the nail. Such nails are time-consuming and messy to mount upon and remove from natural nails, and these artificial nails are difficult to repair when glued upon the natural nail. Sculptured artificial nails are available which require the use of the molds and epoxies to form an artificial nail directly upon the human nail. Generally, such sculptured nails require application and removal by a specialist. Also, these artificial nail products do not provide a user with quick and easy mounting and removal flexibility.

Examples of artificial fingernails are disclosed in Pettey, U.S. Pat. No. 2,633,139, and Bogoslowsky, U.S. Pat. No. 2,688,331. Each of these patents teach the use of a pressure-sensitive adhesive previously coated upon the artificial fingernails' undersides, for securing the artificial nails to the natural nails. One disadvantage of such artificial nails is that after one or more uses, the adhesive looses its adhesion properties, forcing the user to either discard the artificial nails or use some liquid glue, for example. Bluestone, U.S. Pat. No. 3,972,325, teaches a rubber or foam-like nail protector for protecting the protruding portion of long natural nails, wherein the nail protector is secured to the underside of the natural nail beyond the fingertip via a double-sided, pressure-sensitive adhesive tape. Bluestone is not concerned with nor even alludes to an improved method or apparatus for mounting artificial nails upon natural nails.

SUMMARY OF THE INVENTION

The present invention overcomes the problems in the prior art by providing in one embodiment a tab of double-sided, pressure-sensitive adhesive material, dimensioned for providing a quick and easy means for mounting an artificial nail to a natural nail, wherein the tab can be easily replaced, permitting the artificial nail to be used until it is worn out, and wherein the tab also provides for easy removal of the artificial nail from the natural nail.

BRIEF DESCRIPTION OF THE DRAWINGS

The invention will be hereinafter more specifically explained with reference to some exemplary embodiments depicted in the accompanying drawings, wherein like items are indicated by the same reference designation.

DESCRIPTION OF THE PREFERRED EMBODIMENTS

Figure 1:
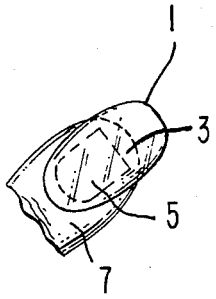
FIG. 1 is a top view of an artificial nail mounted upon a natural fingermail or toenail via one embodiment of the invention.
Figure 2:
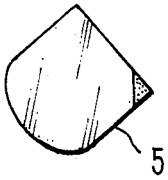
FIG. 2 is a top view of a mounting tab of one embodiment of the invention.
Figure 3:
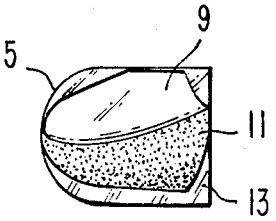
FIG. 3 is an isometric view of a mounting tab of one embodiment of the invention with top and bottom protective layers being peeled away to expose adhesive on each side of the tab.
Figure 4:
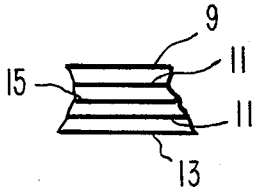
FIG. 4 is a magnified but out of scale view of an edge portion of a double-sided, pressure-sensitive adhesive material.

FIG. 1 illustrates a first embodiment of the present invention which includes an artificial nail 1 mounted upon a fingernail 3 via a mounting tab 5. For completeness, a portion of a finger 7 is also shown. As shown in FIGS. 1 and 2, it is preferred that the tab 5 be dimensioned for covering a substantial portion of the area of a fingernail 3. Within practical limits, a range of differently dimensioned tabs 5 for accomodating different sizes and shapes of fingernails 3 upon which artificial nails 1 are to be mounted can be provided. To use an artificial nail mounting tab 5, for example, one would first peel a protective layer 9 (see FIG. 3) away from one side of a tab 5 to expose the adhesive 11 on that side, and then position and press that side onto a fingernail 3 as shown in FIG. 1. Next, the protective layer 13 is peeled away from the other side of the tab 5 to expose the adhesive on that side, followed by positioning and pressing the artificial nail 1 onto the fingernail 3 and other side of the tab 5. In this manner artificial nail 1 can be properly positioned on the natural nail 3, whereas this may not be as easily accomplished if the tab 5 was first secured to the underside of the artificial nail 1. The adhesive strength of the tab 5 must provide both for retention of the artificial nail 1 upon the fingernial 3 during normal daily activities of the user, and for easy removal of the artificial nail 1 via the application of sufficient force lifting the artificial nail 1 away from the natural nail 3 to break the adhesive force of the tab 5. As shown in FIG. 4, a double-sided, pressure-sensitive adhesive material from which tabs 5 can be fabricated includes a suitable carrier 15, such as a plastic sheet or film, coated on each side by a pressure-sensitive adhesive 11, with protective coatings or coverings 9 and 13 (a waxed paper, for example) covering the adhesive 11 on each side of the tape.

The present inventor has discovered that a suitable tape for providing the tabs 5 is commercially available under the name "Super-stik, Double Faced Tape, manufactured by the Superior Insulating Tape Co., St. Lous, Mo. In addition to providing the necessary adhesion qualities previously mentioned, this tape is thin (approximately 0.005 inch thick) enough to not lift an artificial nail 1 noticeably away from the natural nail 3 of a user of the subject tabs 5, but still thick enough to provide reinforcement of the mechanical or structural strenth of the artificial nail 1.

Figure 5:
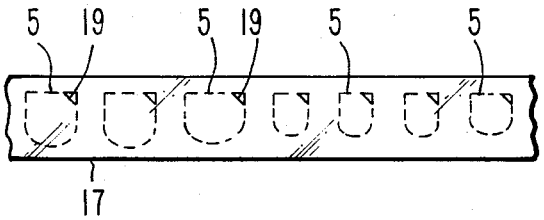
FIG. 5 is a partial top view of a third embodiment of the invention including a strip of mounting tabs.
Figure 6:
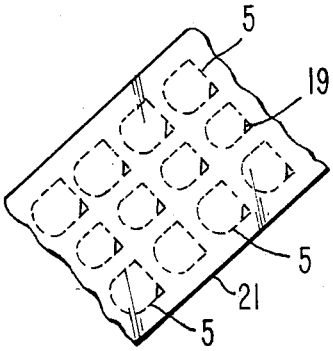
FIG. 6 is a partial top view of another embodiment of the invention including a sheet of mounting tabs.
Figure 7:
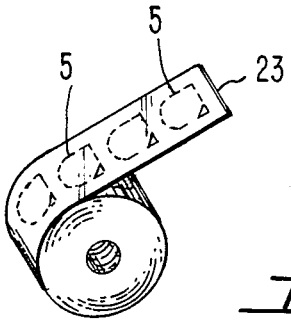
FIG. 7 is an isometric or pictorial view of a fourth embodiment of the invention including a roll of mounting tabs.

Another embodiment of the invention is shown in FIG. 5, as a strip of double-sided pressure-sensitive adhesive tape or material 17 including a plurality of partially cutout tabs 5 of the same or different dimensions, or some combination thereof. A user merely selects and pushes out the tab desired. The embossed lines 19 are provided on each side of the protective layers 9, 13, of the tabs 5 to facilitate removal of the protective layers 9, 13. Similarly, a plurality of such partially cutout tabs 5 are provided in other embodiments of the invention on a sheet 21 or roll 23 of double-sided, pressure-sensitive adhesive coated material, as shown in FIGS. 6 and 7, respectively.

Figure 8:
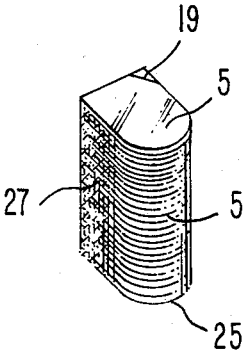
FIG. 8 is a pictorial view of a fifth embodiment of the invention including a stack of mounting tabs.

In FIG. 8, a fifth embodiment of the invention includes a stack 25 of tabs 5 of the same or some combination of different dimensions, secured together via a strip of appropriate adhesive 27 along the length of the stack 25 (an appropriate adhesive might be provided by rubber cement, for example). Such a stacked pack 25 of tabs 5 provides for compact packaging, and permits a user to selectively remove a single tab 5 from the stack 25 without disturbing other of the tabs 5, by bending the stack 25 in accordian-like fashion.

The mounting tabs 5 of the present invention can be used for mounting any type of artificial nails 1 upon natural nails 3, and permit the artificial nails 1 to be used until worn out or broken. A user simply pulls the artificial nail 1 away from the natural nail 3 to remove the artificial nail 1, and then pulls the tab 5 off of the artificial nail 1 (the usual case), or off of the natural nail 3, if the tab 5 happened to remain on the latter instead of the former. The present inventor discovered that the tabs 5 can be revived after use by pressing their adhesive surfaces against the adhesive surface of a sheet coated with adhesive similar to the original adhesive of the tabs 5. Alternatively, new tabs 5 can be used for each new mounting of an artificial nail 1 to a natural nail 3.

What I claim is:

1. A method for providing a disposable and replaceable artificial nail mounting tab and reinforcement for permitting reuse of said nail until it wears out and for facilitating the securing to and removal from a natural nail of said artificial nail, comprising the steps of:

(1) shaping an appropriate double-sided, pressure-sensitive adhesive material to form a tab for covering a substantial portion of the area of the outside surface of a human or natural nail, upon which it is desired to mount an artificial nail;

(2) securing one side of said tab to the outer surface of said human or natural nail;

(3) positioning an artificial nail over the other side of said tab and said natural nail; and (4) pressing said artificial nail onto said natural nail, for securely mounting said artificial nail to said natural nail via the adhesive on the other side of said tab.

2. The method of claim 1, further including the step of making the thickness of said double-sided, pressure-sensitive adhesive material of a dimension for providing structural reinforcement of said artificial nail.

3. The method of claims 1 or 2, further including the steps of providing a plurality of said tabs as partial cutouts upon a double-sided, pressure-sensitive adhesive sheet, and dimensioning said tabs to have either the same or different shapes, or some combination thereof, the latter two for providing a selection of tabs for use on nails of different shapes and area, respectively.

4. The method of claims 1 or 2, further including the steps of providing a plurality of said tabs as partial cutouts upon either a strip or roll of pressure-sensitive adhesive tape, and dimensioning said tabs to have either the same or different shapes, or some combination thereof, the latter two for providing a selection of tabs for use on nails of different shapes and area, respectively.

5. The method of claims 1 or 2, further including the steps of stacking together a plurality of said tabs, and coating said stack of tabs with an appropriate adhesive along a strip the length of said stack of tabs, for permitting said tabs to be individually "peeled away" or removed from said stack without disturbing the remaining tabs.

6. The method of claim 1, further including after step (1), the step of peeling away a protective covering from said one side of said tab for exposing the adhesive on that side.

7. The method of claim 1, further including after step (2), the step of peeling away a protective covering from said other side of said tab for exposing the adhesive on that side.

8. A disposable and replaceable mounting tab and reinforcement for an artificial nail, for permitting reuse of said artificial nail until said nail wears out, comprising:

a double-sided, pressure-sensitive adhesive material shaped to form a tab for covering a substantial portion of the area of the outside surface of a human or natural nail upon which it is desired to mount an artificial nail; and first and second protective coverings on one and the other sides of said tab, whereby in one procedure for using said tab, said first protective covering is removed from said tab to expose the adhesive on said one side for securing this side to said natural nail, after which said second protective covering is removed for exposing the adhesive on the other side of said tab for securing this side to said artificial nail, thereby securing said artificial nail to said human or natural nail.

9. The mounting tab of claim 8, wherein said adhesive material is of a thickness for providing reinforcement of the artificial nail it secures to a natural nail.

10. The mounting tab of claims 8 or 9, further including:

a sheet of double-sided, pressure-sensitive material having a plurality of said mounting tabs formed thereon as partial cutouts, said tabs being either one or a combination of different size(s), the latter for selectively providing tabs for different size natural nails.

11. The mounting tab of claims 8 or 9, further including:

either one of a strip or roll of double-sided, pressure-sensitive adhesive tape having a plurality of said mounting tabs formed thereon as partial cutouts, said tabs being either one or a combination of different size(s), the latter providing tabs for different sizes or shapes of human or natural nails, respectfully.

12. The mounting tab of claims 8 or 9, further including:

a plurality of said tabs formed into a stack; and an appropriate adhesive coated along a strip of the length of said stack, for permitting selective removal of one tab of said stack without disturbing the placement of the other tabs in said stack.

13. A disposable and replaceable mounting tab and reinforcement for an artificial nail, for permitting reuse of said artificial nail until it wears out, and for facilitating the securing and removal of said artificial nail from a natural nail, comprising a double-sided, pressure-sensitive adhesive material dimensioned for covering a substantial portion of a natural nail, one side of said tab being secured to the surface of the natural nail, the other side of said tab being secured to a portion of the undersurface of an artificial nail, said tab thereby providing both a mounting and reinforcement means for said artificial nail.

* * * * *